US007178340B2

(12) United States Patent
Jorgensen

(10) Patent No.: US 7,178,340 B2
(45) Date of Patent: Feb. 20, 2007

(54) TRANSITION DUCT HONEYCOMB SEAL

(75) Inventor: Stephen W. Jorgensen, Stuart, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 628 days.

(21) Appl. No.: 10/669,924

(22) Filed: Sep. 24, 2003

(65) Prior Publication Data

US 2005/0063816 A1 Mar. 24, 2005

(51) Int. Cl.
*F01D 25/24* (2006.01)
*F02C 7/20* (2006.01)

(52) U.S. Cl. ..... 60/800; 415/138

(58) Field of Classification Search ..... 60/799, 60/800; 415/138
See application file for complete search history.

(56) References Cited

U.S. PATENT DOCUMENTS 5,161,945 A * 11/1992 Clevenger et al. ..... 415/177
6,171,052 B1 1/2001 Aschenbruck et al.
6,251,494 B1 6/2001 Schreiber
6,450,762 B1 9/2002 Munshi
6,499,742 B1 * 12/2002 Zhou et al. ..... 277/355
6,619,915 B1 9/2003 Jorgensen
2004/0239040 A1 * 12/2004 Burdgick ..... 277/414

OTHER PUBLICATIONS

U.S. Appl. No. 10/064,768, Hollis et al.
U.S. Appl. No. 10/295,481, Sileo et al.
U.S. Appl. No. 10/350,757, Jorgensen.

* cited by examiner

*Primary Examiner*—Michael Koczo, Jr.

(57) ABSTRACT

A sealing device for use between a gas turbine combustor transition duct aft frame and a turbine inlet having improved durability, reduced wear on the mating turbine vane, and reduced manufacturing costs, is disclosed. The sealing device has a circumferential length, an axial width, and a radial height and contains a plurality of channels extending axially along the seal inner surface for passing a controlled amount of cooling air to a turbine inlet. The sealing device is formed of abradable honeycomb having a plurality of honeycomb cells with the honeycomb cells oriented to ensure maximum control against cooling air leakage while also providing maximum flexibility during assembly. The sealing device is captured between the transition duct aft frame, bulkhead, and turbine vane platform, thereby allowing easy replacement of the seal without requiring major disassembly of the transition duct aft frame section.

13 Claims, 7 Drawing Sheets

TRANSITION DUCT HONEYCOMB SEAL

TECHNICAL FIELD

This invention applies to the combustor section of gas turbine engines used in powerplants to generate electricity. More specifically, this invention relates to the sealing structure between a transition duct and the inlet of a turbine.

BACKGROUND OF THE INVENTION

In a typical can-annular gas turbine engine, a plurality of combustors are arranged in an annular array about the engine. The combustors receive pressurized air from the engine's compressor, add fuel to create a fuel/air mixture, and combust that mixture to produce hot gases. The hot gases exiting the combustors are utilized to turn a turbine, which is coupled to a shaft that drives a generator for generating electricity.

In a typical gas turbine engine, transition ducts are surrounded by a plenum of compressed air from the engine's compressor. This air is directed to the combustors and also cools the transition duct walls. Due to the pressure loss associated with the combustion process, the hot gases within the transition duct that enter the turbine are at a lower pressure than the compressed air surrounding the transition ducts. Unless the joints between the transition duct and turbine inlet are properly sealed, excessive amounts of compressed air can leak into the turbine, thereby bypassing the combustor, and resulting in engine performance loss. A variety of seals have been utilized in this region to minimize leakage of compressed air into the turbine. Some examples include "floating" metal seals, brush seals, cloth seals, and corrugated metal seals, depending on the transition duct aft frame configuration. Older gas turbine combustion systems use "floating" metal seals that are manufactured from a formed plate or sheet metal and are installed such that they can "float" between the aft frame and turbine inlet. Though the "floating" metal seals are quite common, they still have some shortcomings, such as stiffness and tendency to lock in place. Seals that are too stiff cannot adequately comply with relative thermal growth between the transition duct and turbine inlet. If the seals lock in place they cannot adjust to thermal changes and will leave gaps between the transition duct and turbine inlet, allowing compressed air to leak into the turbine.

More recently, corrugated "W" shaped metal seals have been utilized to ensure that a constant contact is maintained between the transition duct and turbine section. The corrugated seal has a spring effect associated with the corrugations and serves to keep the seal in contact with the vane platform of the turbine inlet at all times, thereby reducing leakage as well as having increased flexibility. An example of this type of seal is shown in FIG. 1. Transition duct 10 contains corrugated seal 11 that contacts duct 10 at a first sealing point 12 and turbine vane platform 13 at a second sealing point 14. Corrugated seal 11 is fabricated from relatively thin sheet metal and the multiple corrugations 15 ensure that seal 11 maintains constant contact with transition duct 10 and vane platform 13. While this seal configuration satisfactorily controls cooling air leakage, it tends to wear out prematurely due to its lack of thickness and the constant contact with the harder vane material. As a result of this shortcoming, a wear strip was added to corrugated seal 11 along the contact surface with duct 10 and vane platform 13, in order to extend the sea life. This enhanced seal configuration is shown in FIG. 2 with transition duct 10 containing a corrugated seal 21 that contacts duct 10 via wear strip 22 at a first sealing point 12 and turbine vane platform 13 at a second sealing point 14. As with corrugated seal 11, corrugated seal 21 is also fabricated from relatively thin sheet metal and the multiple corrugations 15 ensure that seal 21 maintains constant contact with transition duct 10 and vane platform 13 along wear strip 22. The addition of wear strip 22, however, caused measurable wear upon vane platform 13 due to the increased hardness of the seal wear strip material compared to the vane platform material and the constant contact between the wear strip and the vane platform due to the spring of the corrugated seal. As a result, turbine vane platforms 13 began exhibiting signs of wear, which must be addressed during a standard repair cycle.

The present invention seeks to overcome the shortfalls described in the prior art by specifically addressing the issues of wear to the transition duct and the turbine vanes by providing an improved sealing system that ensures a sufficient seal that minimizes undesirable cooling air leakage, provides an adequate amount of cooling to the turbine vane platforms, and is fabricated for a lower cost. It will become apparent from the following discussion that the present invention overcomes the shortcomings of the prior art and fulfills the need for an improved transition duct to turbine inlet seal.

SUMMARY AND OBJECTS OF THE INVENTION

A sealing device for use between a gas turbine combustor transition duct aft frame and a turbine inlet having improved durability, reduced wear on the mating turbine vane, and reduced manufacturing costs, is disclosed. The sealing device comprises a first end and second end in spaced relation forming a circumferential length, a forward face and an aft face in spaced relation forming an axial width, and an inner surface and an outer surface in spaced relation forming a radial height. A plurality of channels extends axially along the inner surface for passing a known amount of cooling air to cool the turbine vane platform. The sealing device is formed of abradable honeycomb having a plurality of honeycomb cells, with each cell having a wall thickness and cell width. The honeycomb cells are oriented generally perpendicular to the transition duct aft frame to ensure maximum control against cooling air leakage while also providing maximum flexibility during assembly. A nominal portion of the sealing device axial width is "crushed" during assembly in order to preload the sealing device against the turbine vane platform. Since the sealing device is fabricated from a softer material than the turbine vane platform and the vane platform will move into the sealing device due to relative thermal expansion during operation, some initial wear will occur to the sealing device. However, unlike previous spring-like seals having corrugations, the honeycomb sealing device will not be under a constant mechanical load to maintain steady contact with the vane platform, and therefore, will only be subject to some initial wear. However, due to the relative thermal expansions between the sealing device and turbine vane platform and honeycomb cell configuration, a constant seal is maintained to prevent unwanted cooling air from leaking into the turbine while allowing a controlled amount of airflow through the plurality of channels to cool the turbine vane platforms.

It is an object of the present invention to provide a transition duct sealing device that restricts undesired cooling air from entering the turbine section of a gas turbine engine.

It is another object of the present invention to provide a transition duct sealing device that minimizes wear of the turbine vane platform.

It is yet another object of the present invention to provide a transition duct sealing device that has an extended life compared to than prior art seals that is also easily replaceable should replacement be required.

In accordance with these and other objects, which will become apparent hereinafter, the instant invention will now be described with particular reference to the accompanying drawings.

DETAILED DESCRIPTION OF THE PREFERRED EMBODIMENT

Figure 3:
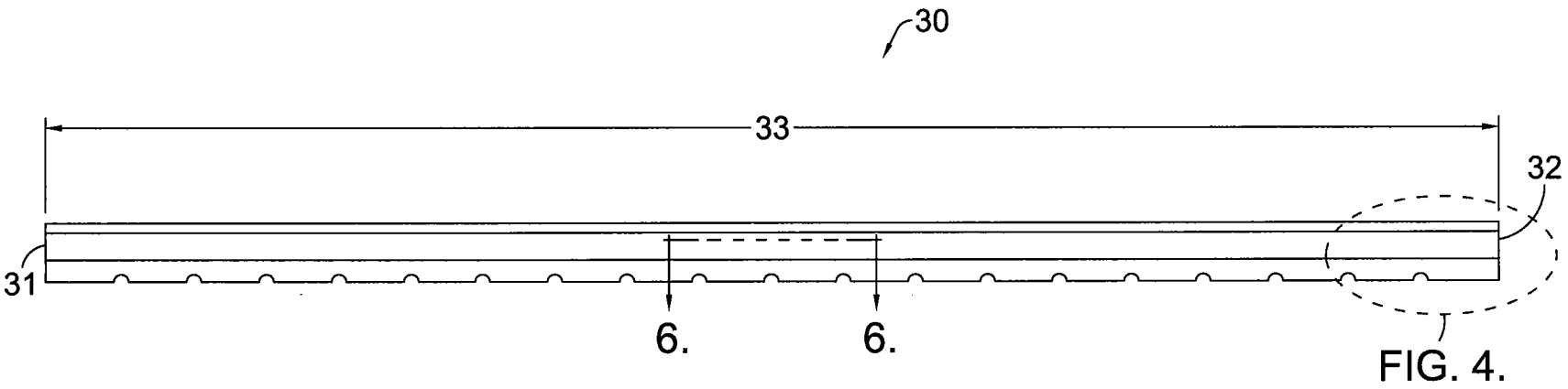
FIG. 3 is a plane view of the sealing device in accordance with the present invention.
Figure 4:
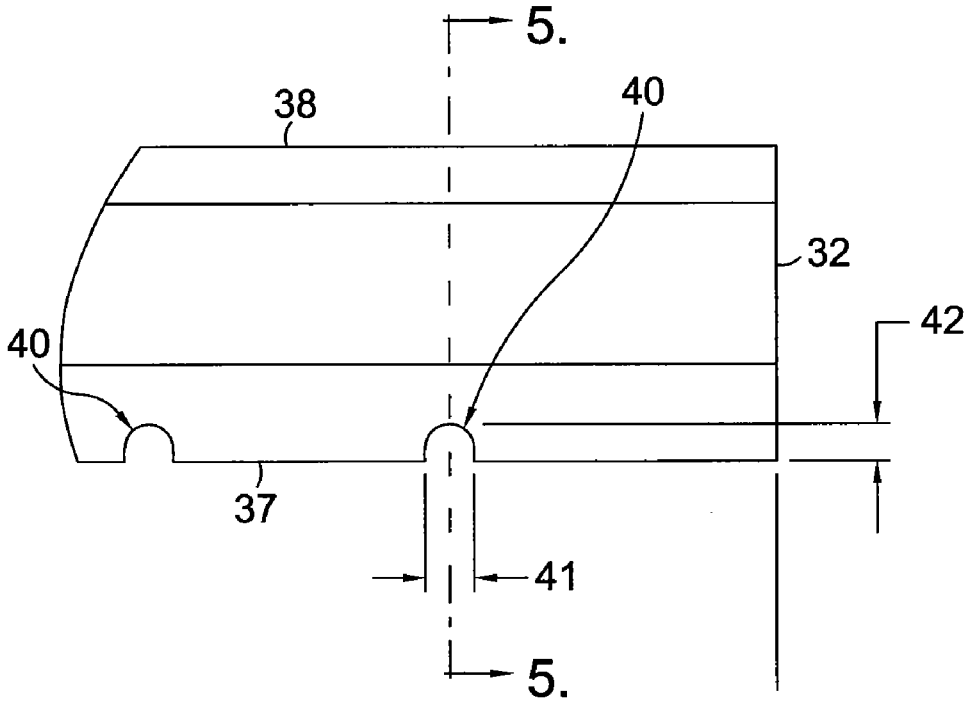
FIG. 4 is a detailed plane view of a portion of the sealing device in accordance with the present invention.
Figure 5:
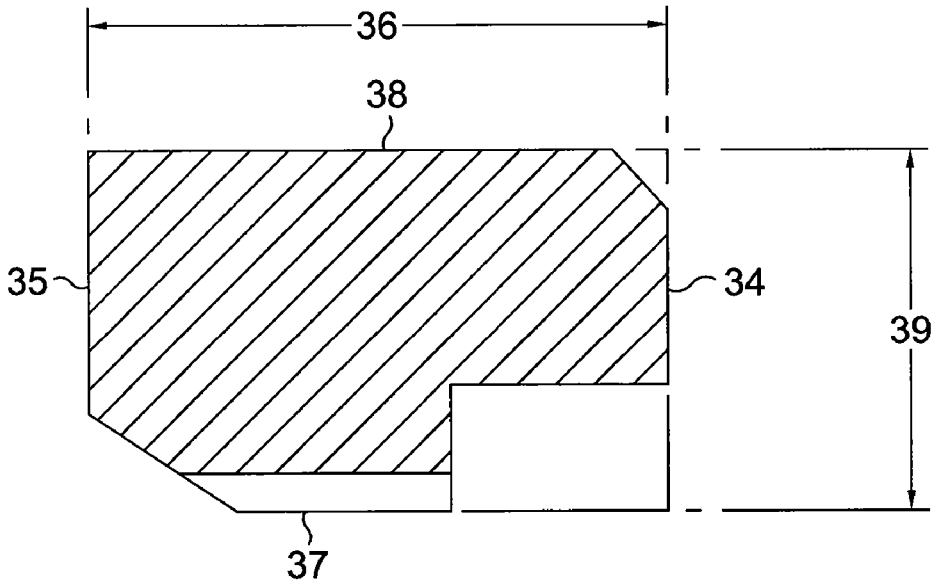
FIG. 5 is an end view of the sealing device in accordance with the present invention.
Figure 6:
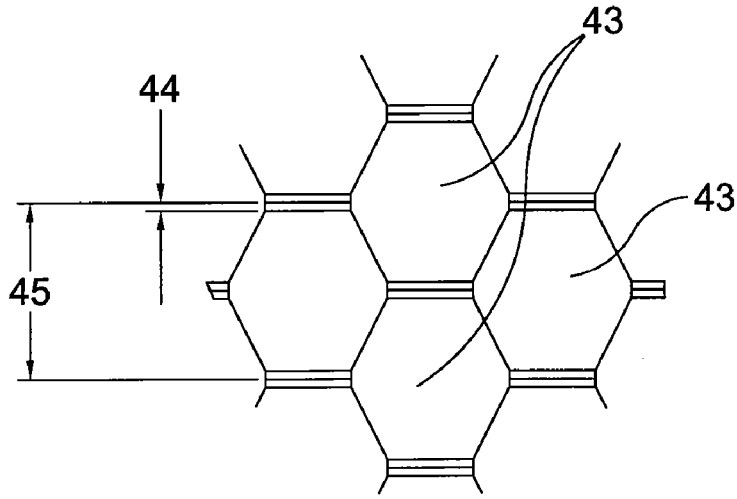
FIG. 6 is a partial section view cut through the plane view of FIG. 3 detailing the honeycomb structure of the sealing device in accordance with the present invention.
Figure 7:
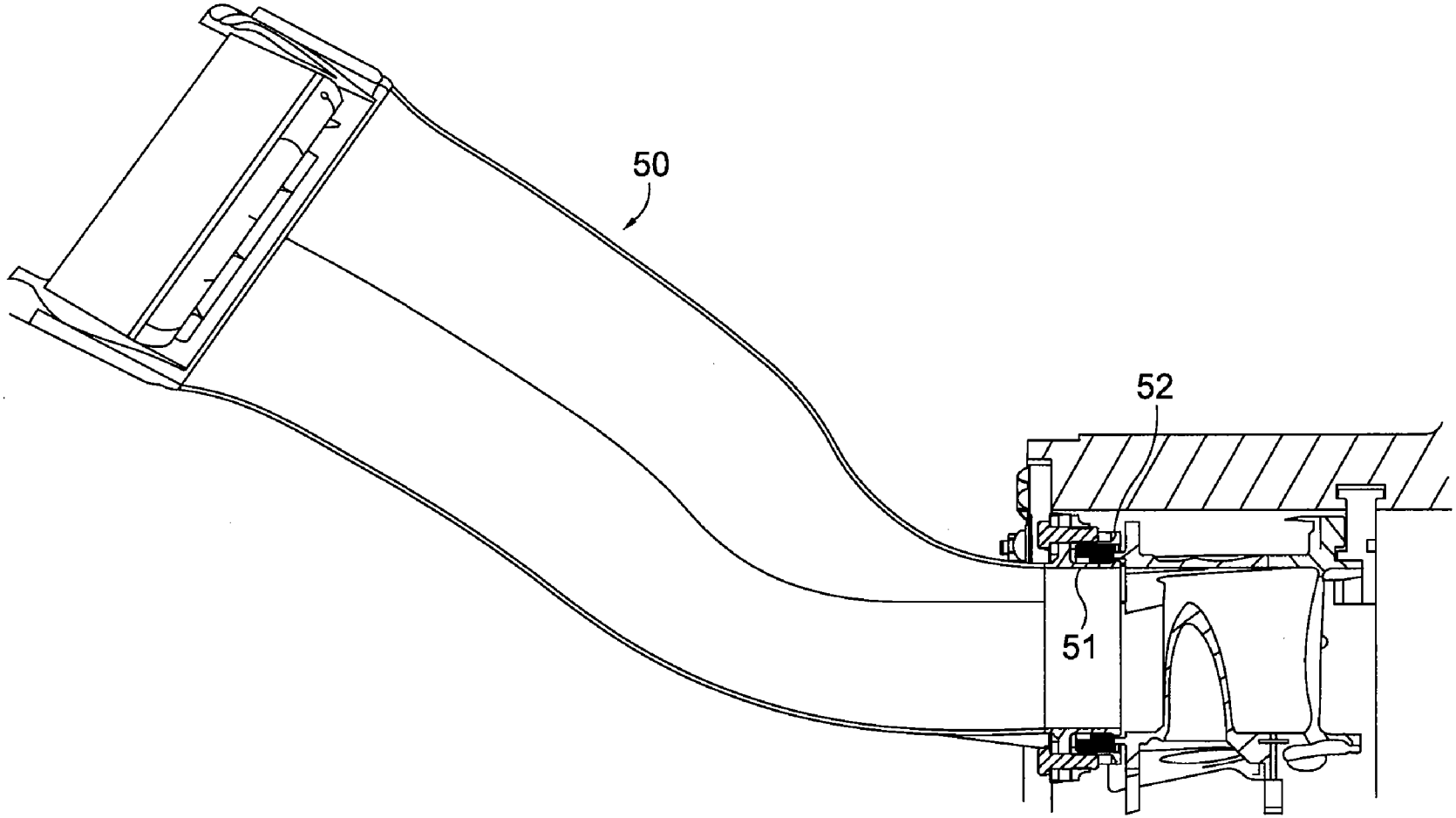
FIG. 7 is a cross section view of a gas turbine transition duct and inlet to a turbine that utilizes the present invention.
Figure 8:
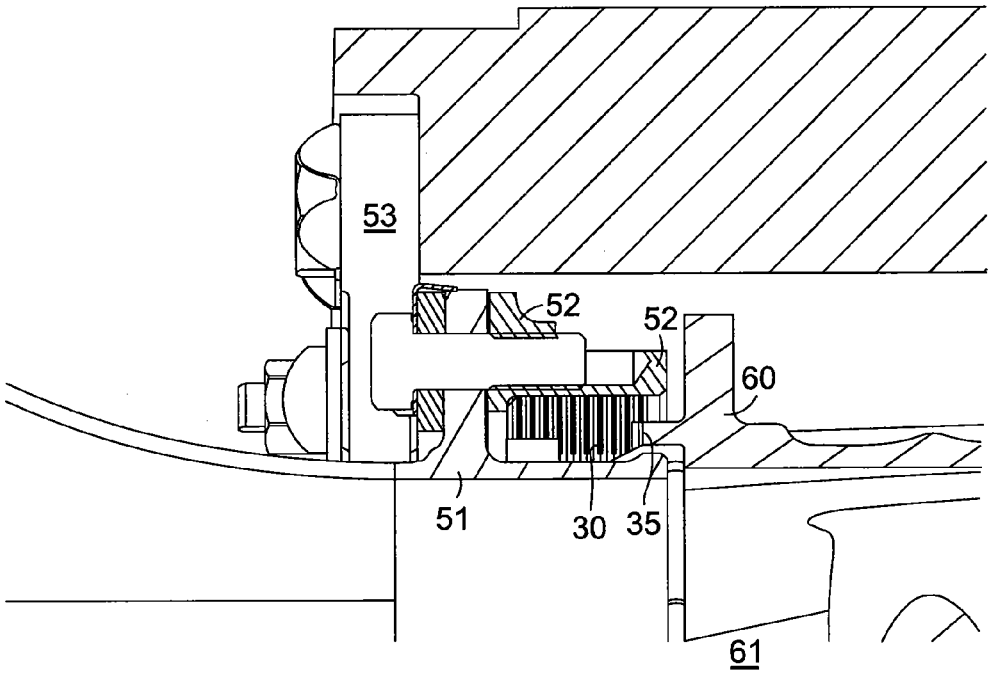
FIG. 8 is a detailed cross section view of a gas turbine transition duct aft frame and turbine inlet incorporating the sealing device in accordance with the present invention.

The preferred embodiment of the present invention is shown in detail in FIGS. 3–6 and installed on a gas turbine combustor transition duct in FIGS. 7 and 8. The sealing device is preferably designed for use between a gas turbine combustor transition duct aft frame and a turbine inlet region. Referring now to FIG. 3, sealing device 30 is shown in plane view and comprises a first end 31 and a second end 32 in spaced relation thereby forming a circumferential length 33. FIG. 5 shows an end view of sealing device 30 that depicts a forward face 34 and an aft face 35 in spaced relation thereby forming an axial width 36. Furthermore, sealing device 30 has an inner surface 37 and an outer surface 38 in spaced relation thereby forming a radial height 39.

Referring back to FIG. 4, a portion of sealing device 30 is shown in greater detail. A plurality of channels 40 is shown extending axially along inner surface 37. Each of channels 40 has a channel width 41 and a channel depth 42. In the preferred embodiment of the present invention, channel width 41 is at least 0.100 inches with channel width 41 at least 1.2 times greater than channel depth 42. This channel geometry arrangement ensures that a controlled amount of cooling air is allowed to pass through sealing device 30 in order to cool the turbine vane platforms at the turbine inlet. While specific channel dimensions have been disclosed, one skilled in the art of gas turbine combustors will understand that a variety of channel geometries may be utilized in sealing device 30 to provide the cooling air required to cool the turbine vane platforms.

A cross section view through sealing device 30 is shown in detail in FIG. 6. This cross section view shows that sealing device 30 is fabricated from abradable honeycomb having a plurality of honeycomb cells 43, with each cell having a wall thickness 44 and a cell width 45. In the preferred embodiment, wall thickness 44 is approximately between 0.0014 inches and 0.003 inches while the cell width is approximately between 0.062 inches and 0.125 inches. A honeycomb configuration with these cell dimensions ensures adequate crush capability during initial assembly with the turbine vane platforms while utilizing a standard honeycomb geometry and providing a structurally sufficient sealing device.

Figure 1:
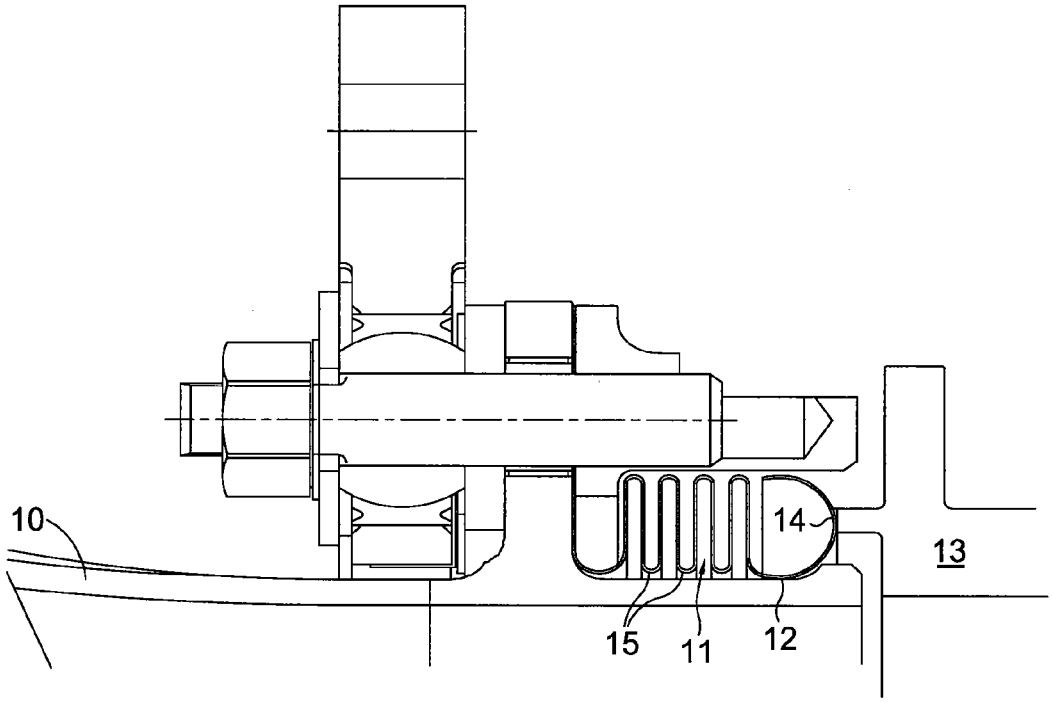
FIG. 1. PRIOR ART
FIG. 1 is a cross section view of a portion of a gas turbine transition duct detailing the sealing region with the turbine inlet that utilizes a corrugated seal of the prior art.
Figure 2:
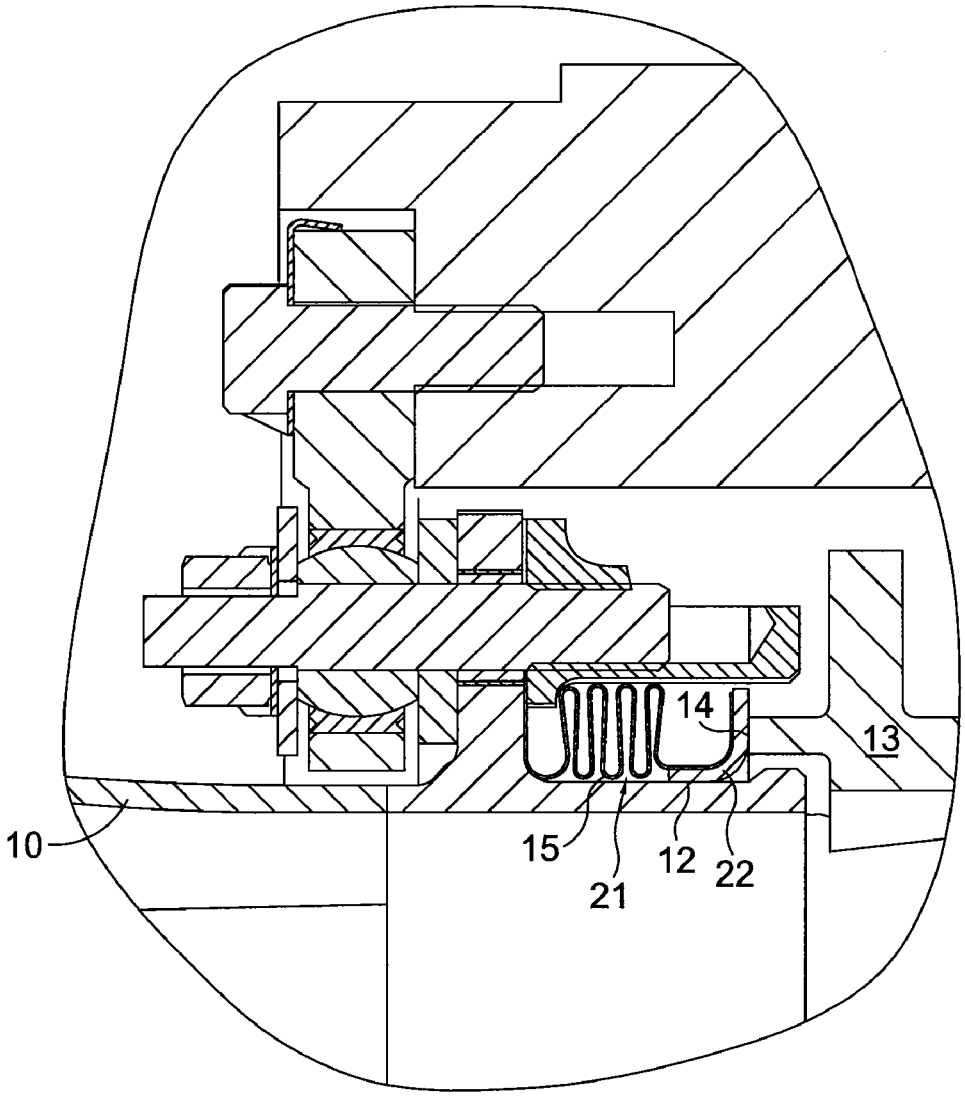
FIG. 2. PRIOR ART
FIG. 2 is a cross section view of a portion of a gas turbine transition duct detailing the sealing region with the turbine inlet that utilizes an alternate embodiment corrugated seal of the prior art.

The sealing device in accordance with the present invention is primarily utilized to seal the region between the aft frame of a gas turbine transition duct and the vane platforms of a turbine inlet. Referring now to FIGS. 7 and 8, a gas turbine transition duct 50 utilizing the present invention is shown in cross section. Transition duct 50 has an aft frame 51 and preferably at least one bulkhead 52 attached to aft frame 51. When the preferred embodiment of the sealing device is assembled to transition duct 50, sealing device 30 is surrounded on three sides by the transition duct aft frame 51 and the bulkhead 52. The sealing device is enclosed on the fourth side, along aft face 35, by turbine vane platform 60. To prevent cooling air leakage into turbine inlet 61, sealing device 30 is in sealing contact with aft frame 51, bulkhead 52, and turbine vane platform 60. However, it is preferred that sealing device 30 not be permanently fixed to any of these features, thereby allowing for sealing device 30 to be replaced without having to disconnect bulkhead 52 from aft frame 51. Allowing bulkhead 52 and mounting assembly 53 to remain assembled during replacement of sealing device 30, reduces overhaul time and repair costs by permitting this replacement to be completed in the field without any major assembly tooling. Prior art sealing configurations, such as the configuration shown in FIG. 2, required disassembly of mounting assembly 53 and the use of major assembly tooling in order to replace corrugated seal 11.

An additional advantage of sealing device 30 is its reduced manufacturing cost. Prior art corrugated seals required complex tooling to form the tight tolerance corrugations in order to ensure a constant spring effect. Sealing device 30 utilizes a standard size honeycomb structure that is manufactured in long strips, machined to the desired cross section, and cut to the desired circumferential length. Honeycomb cells 43, which form the abradable honeycomb, are oriented in a direction that is generally perpendicular to aft frame 51, and therefore are relatively flexible and can bend as necessary to conform to the walls of the arc-shaped aft frame.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. A sealing device for use between a gas turbine combustor transition duct aft frame and a turbine inlet, said sealing device comprising:

a first end and a second end in spaced relation thereby forming a circumferential length;

a forward face and an aft face in spaced relation thereby forming an axial width;

an inner surface and an outer surface in spaced relation thereby forming a radial height;

a plurality of channels extending axially along said inner surface, said channels having a channel width and channel depth, said channels capable of passing a controlled amount of a cooling fluid through said sealing device to cool vane platforms at said turbine inlet; and, wherein said sealing device is formed of abradable honeycomb having a plurality of honeycomb cells, each cell having a wall thickness and a cell width.

2. The sealing device of claim 1 wherein said channel width is at least 0.100 inches.

3. The sealing device of claim 2 wherein said channel width is at least 1.2 times greater than said channel depth.

4. The sealing device of claim 1 wherein said cooling fluid is compressed air.

5. The sealing device of claim 1 wherein said wall thickness of said honeycomb is approximately between 0.0014 inches and 0.003 inches.

6. The sealing device of claim 1 wherein said cell width is approximately between 0.062 inches and 0.125 inches.

7. A gas turbine transition duct sealing system comprising:

a transition duct for transferring hot gases from a combustor to a turbine, said transition duct having an aft frame with at least one bulkhead attached to said aft frame;

a sealing device fixed to said at least one bulkhead, said sealing device comprising:

a first end and second end in spaced relation thereby forming a circumferential length;

a forward face and an aft face in spaced relation thereby forming an axial width;

an inner surface and an outer surface in spaced relation thereby forming a radial height;

a plurality of channels extending axially along said inner surface, said channels having a channel width and channel depth;

wherein said sealing device if formed of abradable honeycomb having a plurality of honeycomb cells, each cell having a wall thickness and a cell width;

a turbine inlet region having a plurality turbine vanes, each of said turbine vanes having at least one platform region;

wherein said sealing device is in sealing contact with said bulkhead, said aft frame, and said platform region.

8. The sealing system of claim 7 wherein said channel width is at least 0.100 inches.

9. The sealing system of claim 8 wherein said channel width is at least 1.2 times greater than said channel depth.

10. The sealing system of claim 7 wherein said channels pass a controlled amount of compressed air to cool vane platforms at said turbine inlet.

11. The sealing system of claim 7 wherein said wall thickness is approximately between 0.0014 inches and 0.003 inches.

12. The sealing system of claim 7 wherein said cell width is approximately between 0.062 inches and 0.125 inches.

13. The sealing system of claim 7 wherein said sealing device is fixed to said bulkhead by a means such as brazing.

* * * * *